US005826722A

United States Patent [19]

Phillips

[11] Patent Number: 5,826,722

[45] Date of Patent: Oct. 27, 1998

[54] LAMP PACKAGING

[75] Inventor: Bob Phillips, Indianapolis, Ind.

[73] Assignee: ETS, Inc., Indianapolis, Ind.

[21] Appl. No.: 797,493

[22] Filed: Feb. 7, 1997

[51] Int. Cl.[6] ..... B65D 85/42

[52] U.S. Cl. ..... 206/419; 206/421; 206/443; 206/485

[58] Field of Search ..... 206/418, 419, 206/420, 421, 303, 443, 446, 485

[56] References Cited

U.S. PATENT DOCUMENTS

| | | | |
|---|---|---|---|
| 2,564,729 | 8/1951 | Shepard . | |
| 3,048,323 | 8/1962 | Stauffer . | |
| 3,050,230 | 8/1962 | Cohane et al. . | |
| 3,143,274 | 8/1964 | Maize | 206/419 |
| 3,193,095 | 7/1965 | Martino et al. | 206/419 |
| 3,223,234 | 12/1965 | Weiss | 206/419 |
| 3,952,873 | 4/1976 | Pampuch et al. . | |
| 4,381,057 | 4/1983 | Carver | 206/485 |
| 4,714,162 | 12/1987 | Harrison . | |
| 4,834,239 | 5/1989 | Osgood . | |
| 4,953,701 | 9/1990 | Maddock . | |
| 5,078,272 | 1/1992 | Combs . | |
| 5,542,535 | 8/1996 | Dalton . | |
| 5,553,708 | 9/1996 | Lawrence et al. . | |

*Primary Examiner*—David T. Fidei

*Attorney, Agent, or Firm*—Woodard, Emhardt, Naughton, Moriarty & McNett

[57] ABSTRACT

A packaging system is disclosed for a number of elongate tubular lamps. The lamps are oriented along a longitudinal axis and each have a first end opposite a second end along the axis. A first spacer is provided to engage a first end of each of the lamps and maintain spacing therebetween. Similarly, a second spacer engages a second end of each of the lamps to maintain spacing therebetween. A third spacer is positioned between the first and second spacers and includes a first wall defining a first number of openings and second wall defining a second number of openings. The first and second openings are paired to define a number of passages each receiving a corresponding one of the lamps therethrough. The first, second, and third spacers cooperate to provide a packagable lamp set. Moreover, the third spacer includes a handle graspable from a top aspect of the set to lift and carry it.

32 Claims, 7 Drawing Sheets

LAMP PACKAGING

BACKGROUND OF THE INVENTION

The present invention relates to protective packaging for tubular lamps.

Elongate tubular lamps of the type used for, among other things, tanning beds and lighting, are highly susceptible to damage during transport. To reduce damage, various packaging schemes for shipping multiple lamps have arisen. U.S. Pat. Nos. 5,078,272 to Combs; 4,834,239 to Osgood; and 2,564,729 to Shepard are cited as background references concerning these packaging schemes.

In one approach, opposing ends of a group of lamps are isolated from each other by insertion into endcaps. Typically, these endcaps are each formed from a foam material. Unfortunately, foam packaging is generally expensive, difficult to handle, and presents disposal problems. As a result, a recyclable, more "environmentally friendly" lamp packaging material is often desired.

Another drawback with existing lamp packaging is that breakage often occurs during removal from the package once shipping is complete. This problem is particularly common with customers receiving small packaged quantities of tanning bed lamps. These lamps are typically on the order of about 5 to 6 feet in length. Thus, a need exists for a multiple lamp package which is cost-effective, employs environmentally friendly materials, and reduces the chance of damage during unpacking. The present invention satisfies these needs and provides other important advantages.

SUMMARY OF THE INVENTION

The present invention relates to packaging for tubular lamps. Various aspects of the invention are novel, nonobvious, and provide various advantages. Although, the actual nature of the invention covered herein can only be determined with reference to the claims appended hereto, certain features which are characteristic of the preferred embodiments disclosed herein can be described briefly as follows.

One feature of the present invention is a packaging system for a number of elongate tubular lamps. The lamps are oriented along a longitudinal axis and each have a first end opposite a second end along the axis. A first spacer is provided to engage a first end of each of the lamps and maintain spacing therebetween. Similarly, a second spacer engages the second end of each of the lamps to maintain spacing therebetween. A third spacer is positioned between the first and second spacers. This third spacer includes a first wall having a first number of openings and a second wall defining a second number of openings. The first and second openings are paired to define a number of passages each receiving a corresponding one of the lamps therethrough. The first, second, and third spacers cooperate to provide a packagable lamp set. Moreover, the third spacer includes a handle graspable from an exposed side of the third spacer to lift and carry the set.

In another feature of the present invention, the packagable lamp set is enclosed in a box which is openable to expose the top aspect of the set. The handle of the third spacer is further configured to facilitate removal of the set from the box by pulling thereon. Correspondingly, the full weight of the set may be suspended from the handle.

In still another feature of the present invention, the spacers and box are formed from a recyclable corrugated boxboard or cardboard to reduce packaging costs and waste disposal problems.

Accordingly, it is one object of the present invention to provide a lamp packaging system which is easy to carry and remove from packaging.

Another object of the present invention is to provide a rugged, protective packaging system for multiple elongate tubular lamps which may be made from a corrugated cardboard or boxboard material.

Still another object of the present invention is to provide a cost-effective, reliable, and easy to manage lamp packaging system which prevents contact between multiple lamps in the package and ensures a minimum spacing of the lamps from one another and the outer surfaces of an enclosing container.

Further objects, features, aspects, and advantages of the present invention will become apparent from the detailed drawings and description provided herein.

DESCRIPTION OF THE PREFERRED EMBODIMENT

Figure 1:
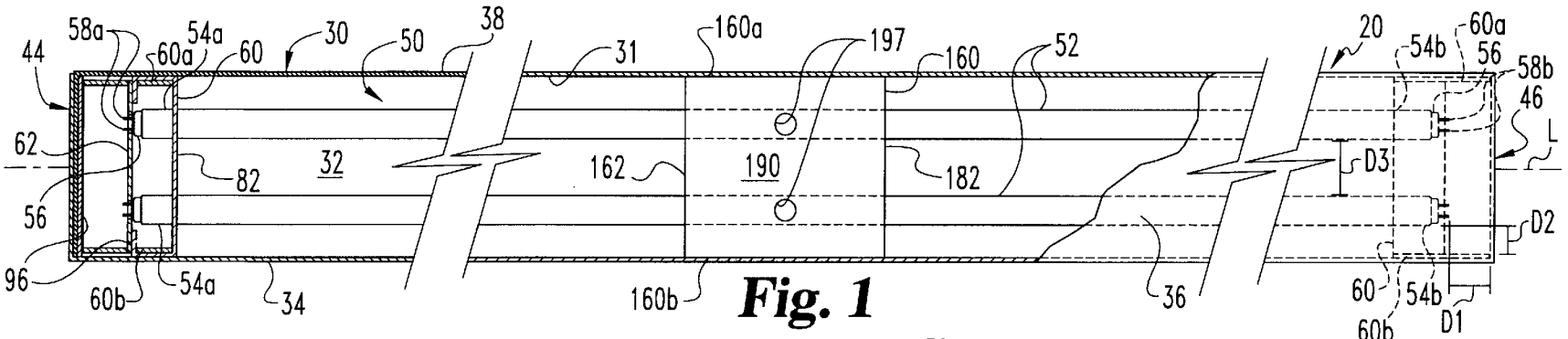
FIG. 1 is a partial cut-away, broken side view of a lamp packaging system of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described device, and any further applications of the principles of the invention as described herein are contemplated as would normally occur to one skilled in the art to which the invention relates.

FIG. 1 depicts lamp packaging system 20 of one embodiment of the present invention. System 20 includes box 30 extending along longitudinal axis L and enclosing lamp set 50. Box 30 has a generally rectangular parallelepiped shape with end wall 44 opposing end wall 46. Lamp set 50 includes a number of generally cylindrical, elongate tubular glass lamps 52 each having opposing ends 54*a*, 54*b*. Each end 54*a*, 54*b* is capped by ferrule 56. A pair of conductive contact pins 58 extend from each ferrule 56 along axis L. Generally, lamps 52 of lamp set 50 are arranged parallel to each other along axis L.

Figure 2:
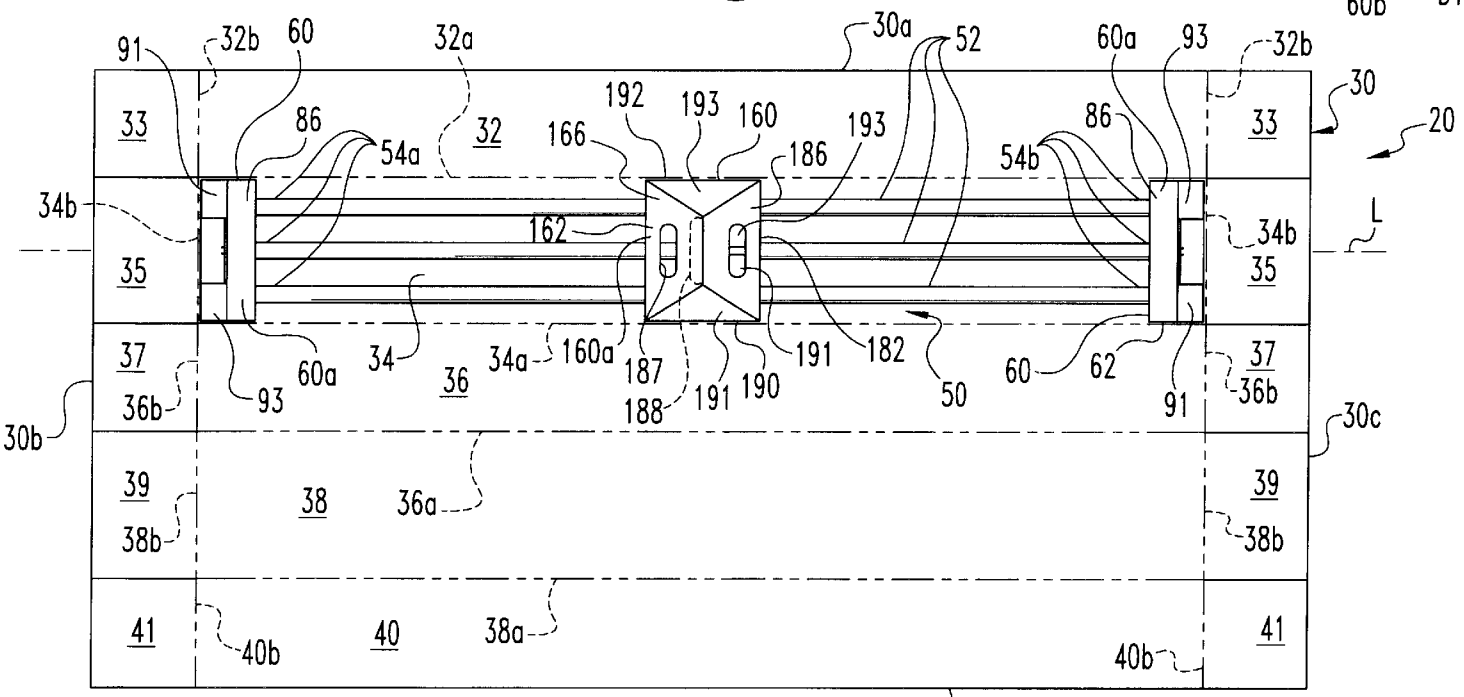
FIG. 2 is a top plan view of the embodiment of FIG. 1 partially unassembled.

Referring additionally to FIG. 2, it should be understood that lamp set 50 is depicted with six lamps 52. Set 50 also includes a pair of end spacers 60 and spacer 160 centrally positioned between end spacers 60. One spacer 60 engages ends 54*a* of lamps 52 and the other spacer 60 engages ends 54*b* of lamps 52. Each lamp 52 also extends through spacer 160.

Box 30 is preferably formed from a generally planar piece of material having margins 30*a*, 30*b*, 30*c*, 30*d* to define a generally rectangular shape as shown in FIG. 2. Box 30 includes sidewall 32 hingedly connected to opposing end flaps 33 at bend lines 32*b*. Sidewall 32 is also hingedly connected to sidewall 34 at bend line 32*a*. Sidewall 34 is hingedly connected to end flaps 35 at bend lines 34*b* and hingedly connected to sidewall 36 at bend line 34*a*. Similarly, sidewall 36 is hingedly connected to opposing end flaps 37 at bend lines 36*b* and sidewall 38 at bend line 36*a*. In turn, sidewall 38 is hingedly connected to opposing end flaps 39 at bend lines 38*b* and sidewall 40 at bend line 38*a*. Sidewall 40 has opposing end flaps 41 hingedly connected at bend lines 40*b*. In FIG. 2, lines between adjacent flaps 33, 35, 37, 39, 41 represent slits which permit bending of individual flaps along corresponding bend lines 32*b*, 34*b*, 36*b*, 38*b*, 40*b*, respectively.

One mode of enclosing lamp set 50 in box 30 from the configuration of FIG. 2 is next discussed. Lamp set 50 is placed on corresponding sidewall 34 as shown. Adjacent sidewalls 32 and 36 are bent about bend lines 32*a* and 34*a*, respectively, to form corresponding rectangular corners. As a result, sidewalls 32 and 36 are positioned opposite one another as shown in FIG. 1. Similarly, box 30 is bent along bend line 36*a* to position sidewall 38 opposite sidewall 34. Sidewall 40 is positioned opposite sidewall 36 by bending at bend line 38*a*. Notably, sidewall 40 contacts sidewall 32 overlapping therewith. End walls 44 and 46 are formed by bending flaps 33, 35, 37, 39, 41 along corresponding bend lines 32*b*, 34*b*, 36*b*, 38*b*, 40*b*. Consequently, box 30 is assembled about lamp set 50 enclosing it therein as illustrated in FIG. 1. Preferably, the edges of flaps 33, 35, 37, 39, and 41, and the exposed edge of sidewall 40 are secured by application of an adhesive tape. Preferably, this tape has a width of about 2 inches.

Figure 3:
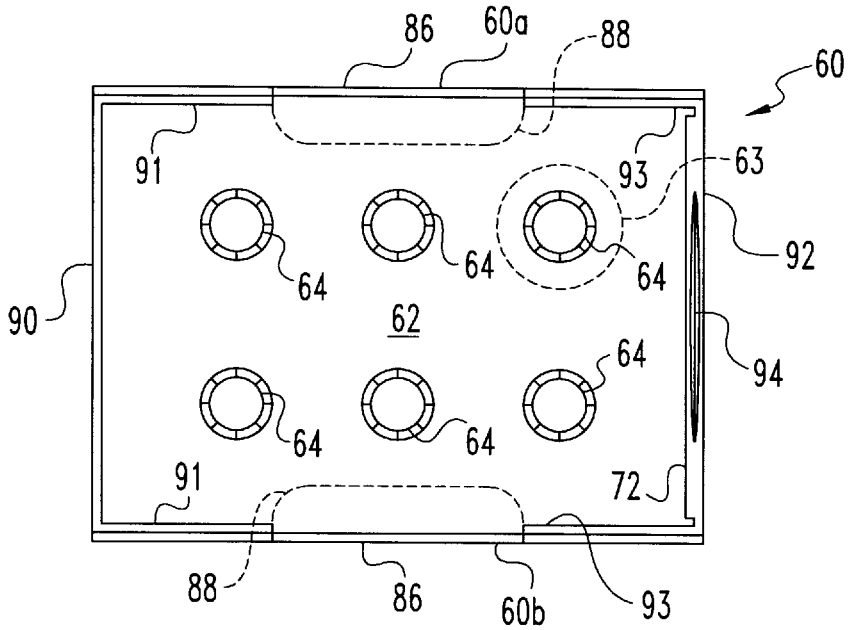
FIG. 3 is a front elevational view of an end spacer of the embodiment of FIG. 1.
Figure 4:
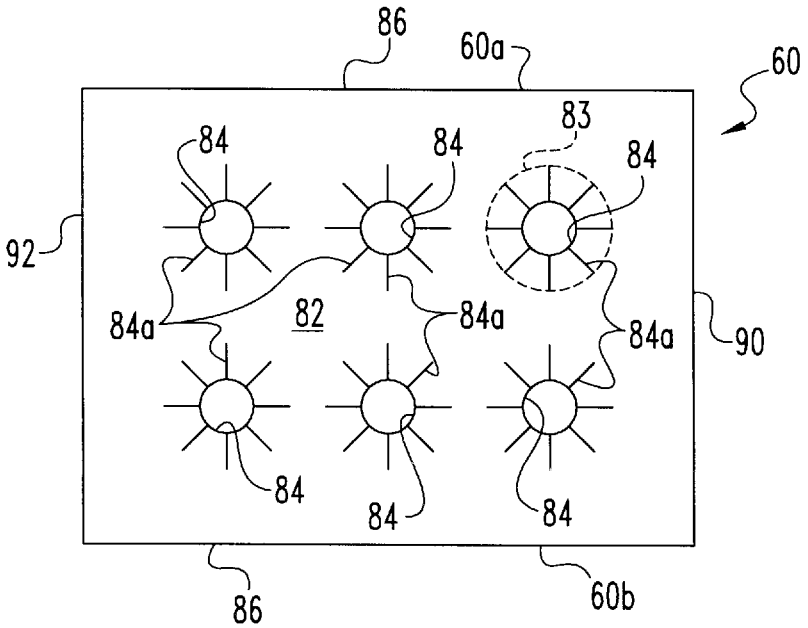
FIG. 4 is a rear elevational view of the end spacer shown in FIG. 3.

Referring additionally to FIGS. 3 and 4, further details about spacer 60 are provided. Spacer 60 has wall 62 spaced apart from wall 82. Wall 62 defines six apertures 64 each corresponding to one of lamps 52 of lamp set 50. Similarly, wall 82 defines apertures 84 each corresponding to one of lamps 52 of lamp set 50. Apertures 84 further include radial slits 84*a*, only a few of which are designated by reference numerals in FIG. 4 to preserve clarity. Each aperture 64 aligns with the corresponding one of apertures 84. Each lamp 52 is configured to engage a corresponding pair of apertures 64, 84. Aperture 84 is sized to permit pins 58 of an end of lamp 52 to pass therethrough without contact; however, corresponding ferrule 56 engages portions of wall 84 between slits 84*a* in associated annular region 83 to bend those portions as it is pushed through aperture 84. A force sufficient to overcome resistance of the bent portions is applied to completely slide lamp 52 through aperture 84. The resulting deformed portions of region 83 are preferably configured to maintain some resistance, even after insertion of lamp 52 through aperture 84, to prevent lamps 52 from sliding relative to spacer 60 under normal storage, packing, transport, and unpacking conditions for lamp set 50.

After extending through aperture 84, corresponding pin pair 58 extends through corresponding aperture 64. Aperture 64 is sized to permit pins 58 to extend therethrough without being contacted by any portion of spacer 60; however, annular region 63 of wall 62 about the corresponding aperture 64 engages corresponding ferrule 56 in a bearing relationship. Consequently, wall 62 operates as a back stop preventing further insertion of lamp 52 into spacer 60, and providing for protective isolation of pins 58 extending through aperture 64. Notably, annular regions 63, 83 generally correspond to a cross-section of lamp 52 along axis L; being approximately circular for the depicted cylindrical shape of lamps 52.

Figure 5:
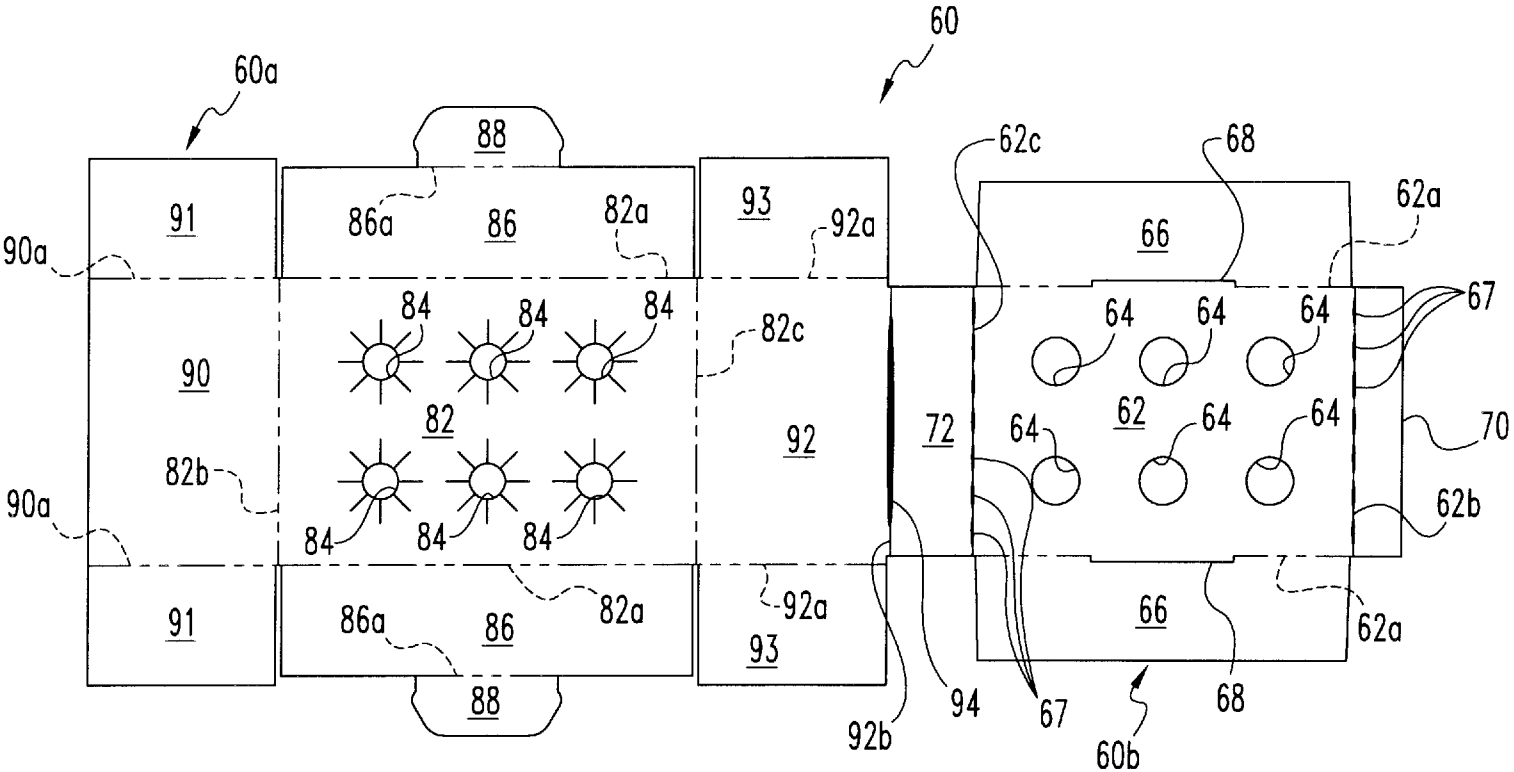
FIG. 5 is a plan view of the end spacer shown in FIG. 3 in a generally planar, unassembled state.

Referring to FIG. 5, formation of spacer 60 is further illustrated. FIG. 5 illustrates a generally planar form of spacer 60 prior to bending and bonding to provide the assembled form of FIGS. 1–4. In FIG. 5, wall 62 is hingedly or foldably connected to inner flaps 66 along bend lines 62*a*. Also defined along bend lines 62*a* are tab slots 68. Wall 62 is also connected to glue flap 70 at hinge line 62*b*. Hinge line 62*b* includes hinge slits 67 aligned along line 62*b* to facilitate bending. Opposite glue flap 70 is inset wall 72. Wall 72 is hingedly connected to wall 62 by hinge line 62*c*. Hinge slits 67 are also formed along line 62*c* to aide with bending.

Wall 82 is hingedly connected to opposing outer flaps 86 along bend lines 82*a*. Flaps 86 are each hingedly connected to opposing interlocking tabs 88 at bend lines 86*a*. Wall 82 is also hingedly connected to sidewall 90 at bend line 82*b*. Sidewall 90 includes opposing corner flaps 91 each hingedly connected to sidewall 90 along corresponding bend line 90*a*. Wall 82 is also hingedly connected to sidewall 92 at bend line 82*c*. Sidewall 92 includes opposing corner flaps 93 each hingedly connected thereto along corresponding bend line 92*a*. Sidewall 92 is also hingedly connected to inset wall 72 by hinge line 92*b*. Hinge slot 94 is provided to facilitate bending about line 92*b* so that inset wall 72 may be adhesively bonded to sidewall 92.

Figure 7:
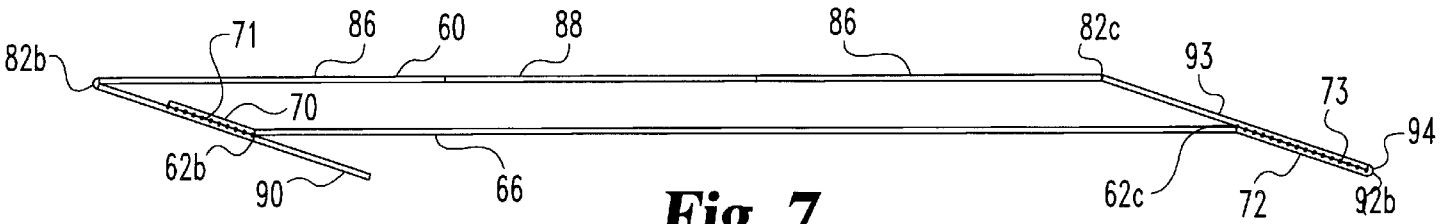
FIG. 7 is a view of the end spacer of FIG. 3 in a partially collapsed state.

In one mode of assembly of spacer 60 from the form of FIG. 5 to the form of FIGS. 1–4, walls 90, 92 are bent toward each other at corresponding bend lines 82*b*, 82*c*. Wall 72 is bent about line 92*b* for bonding to a surface of wall 92 in a generally parallel relationship with adhesive 73. Wall 62 is bent about line 62*c* to position flap 70 next to wall 90. Flap 70 is bent about line 62*b* for bonding to an inner surface of wall 90 with adhesive 71 so that walls 70, 90 are generally parallel. This stage of assembly is generally reflected in the end view of the partially collapsed state of spacer 60 shown in FIG. 7. In FIG. 7, flaps 66, 86, 91, 93 are generally coplanar with walls of spacer 60. Spacer 60 may be further collapsed to be generally flat and occupy a minimal amount of space, which is ideal for storage and transport of spacers 60 prior to incorporation in lamp set 50.

Figure 6:
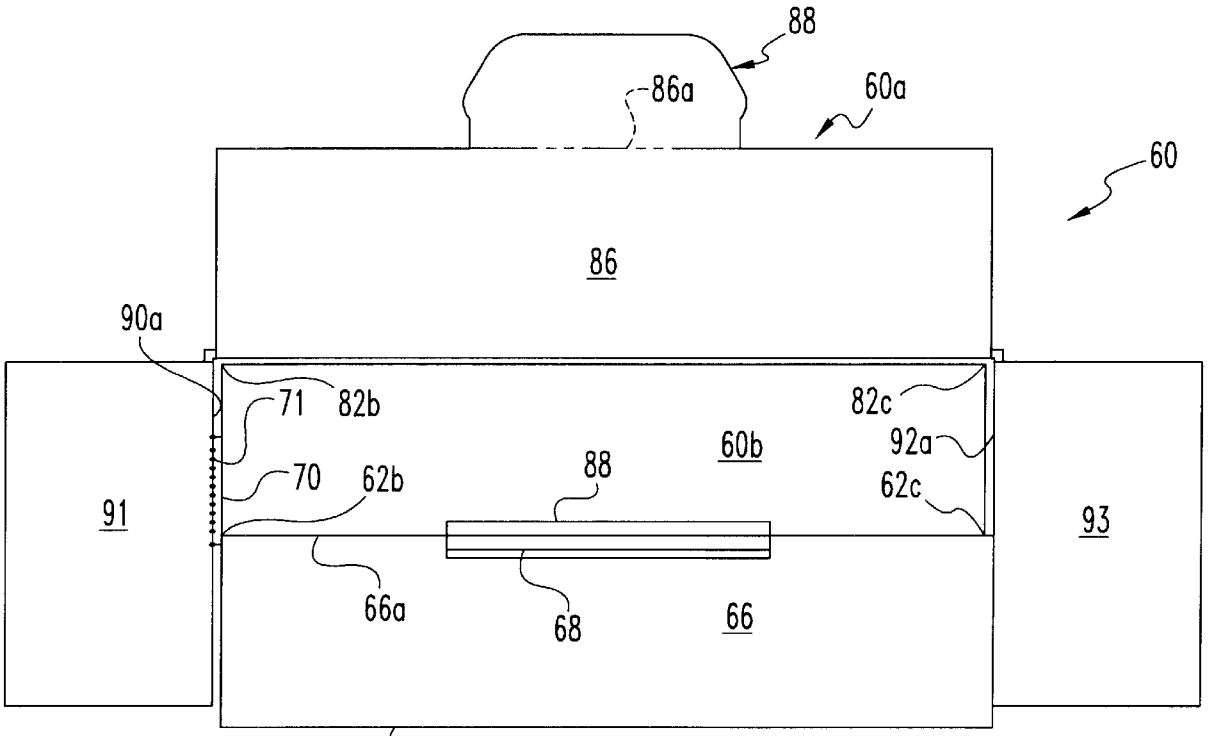
FIG. 6 is a view of the end spacer of FIG. 3 in a partially assembled state.

Referring generally to FIGS. 1–6, spacer 60 includes pairs of flaps 66, 86, 91, 93. Each unique member of these flap pairs is grouped in one of two flap sets designated by reference numerals 60*a*, 60*ba*. The flaps of each set 60*a*, 60*b* engage each other to provide assembled spacer 60 shown in FIGS. 1–4. Referring specifically to FIG. 6, an end view of a partially assembled state of spacer 60 is illustrated. In FIG. 6, flaps of set 60*b* engage each other and are interlocked by the insertion of tab 88 of set 60*b* into tab slot 68 of set 60*b*. Set 60*b* is more distant from the view plane than the flaps of set 60*a*. The flaps of set 60*a* are outwardly bent to be generally coplanar and approximately parallel to the view plane to define an opening into spacer 60 through which set 60*b* may be viewed.

To complete assembly of set 60*a*, flap 66 of set 60*a* is bent about bend line 62*a* toward corresponding flap 86. Next, corner flaps 91, 93 of set 60*a* are bent toward each other about bend lines 90*a*, 92*a*, respectively. Notably, flaps 91, 93 are sized to prevent blockage of slot 68 in this bent position. Next, flap 86 of set 60*a* is bent about bend line 82*a* to position tab 88 of set 60*a* next to slot 68 of set 60*a*. Tab 88 is bent about line 86*a* and inserted into slot 68 to interlock flap set 60*a*. The assembly of set 60*b* is performed in a like manner. Walls 62, 82 and sidewalls 90, 92 extend generally perpendicular to each set 60*a*, 60*b* to provide a rugged rectangular construct with four generally planar sides each configured to contact a sidewall of box 30.

Figure 8:
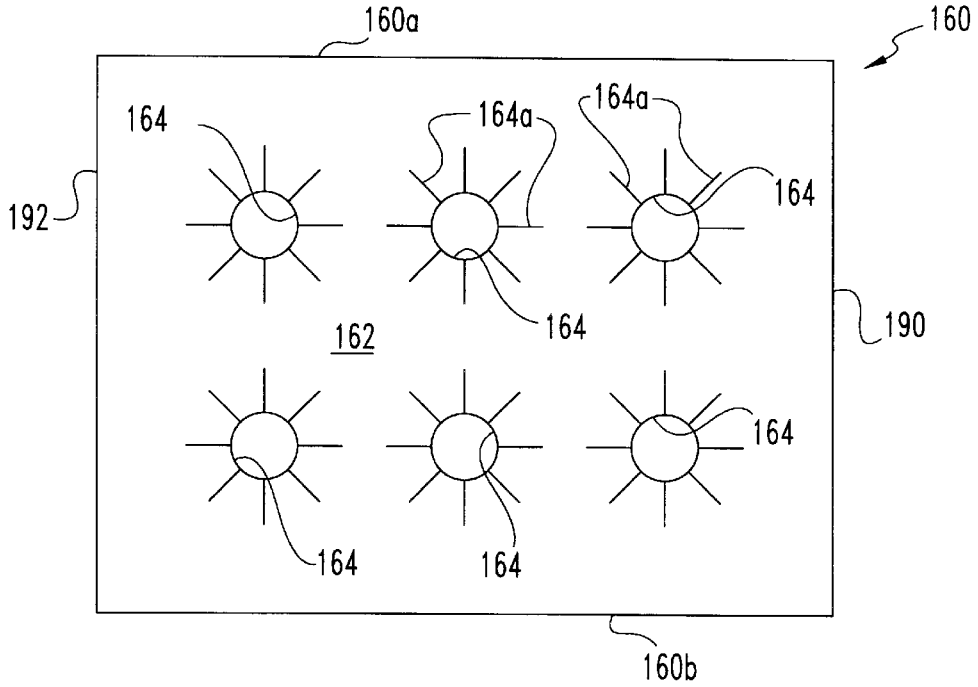
FIG. 8 is a front elevational view of another spacer of the embodiment of FIG. 1.

Referring back to FIGS. 1 and 2; and additionally referring to FIG. 8, selected details about spacer 160 are further illustrated. Spacer 160 includes wall 162 opposite wall 182. FIG. 8 illustrates wall 162 with apertures 164 and corresponding radial slits 164*a*. Only a few of slits 164*a* are designated for clarity. Wall 162 is configured similar to wall 82 of spacer 60 with apertures 64, 184 and slits 64*a*, 184*a* being similarly sized and spaced (Compare FIGS. 8 and 4). Wall 182 is configured similar to wall 162 with corresponding apertures 184 and radial slits 184*a* that are similar to apertures 164 and slits 164*a*. (see FIG. 9).

Apertures 164 and 184 are each paired to define a passage to receive a corresponding lamp 52. Portions between radial slits 164*a*, 184*a* are configured to deform to yieldingly hold a lamp inserted therethrough comparable to the arrangement of apertures 84 of spacer 60. Preferably, apertures 164, 184 and slits 164*a*, 184*a* respectively, are configured to snugly retain lamps 52 therein without breakage under conditions usually encountered during storage, packing, transport, and unpacking of lamp set 50.

Figure 9:
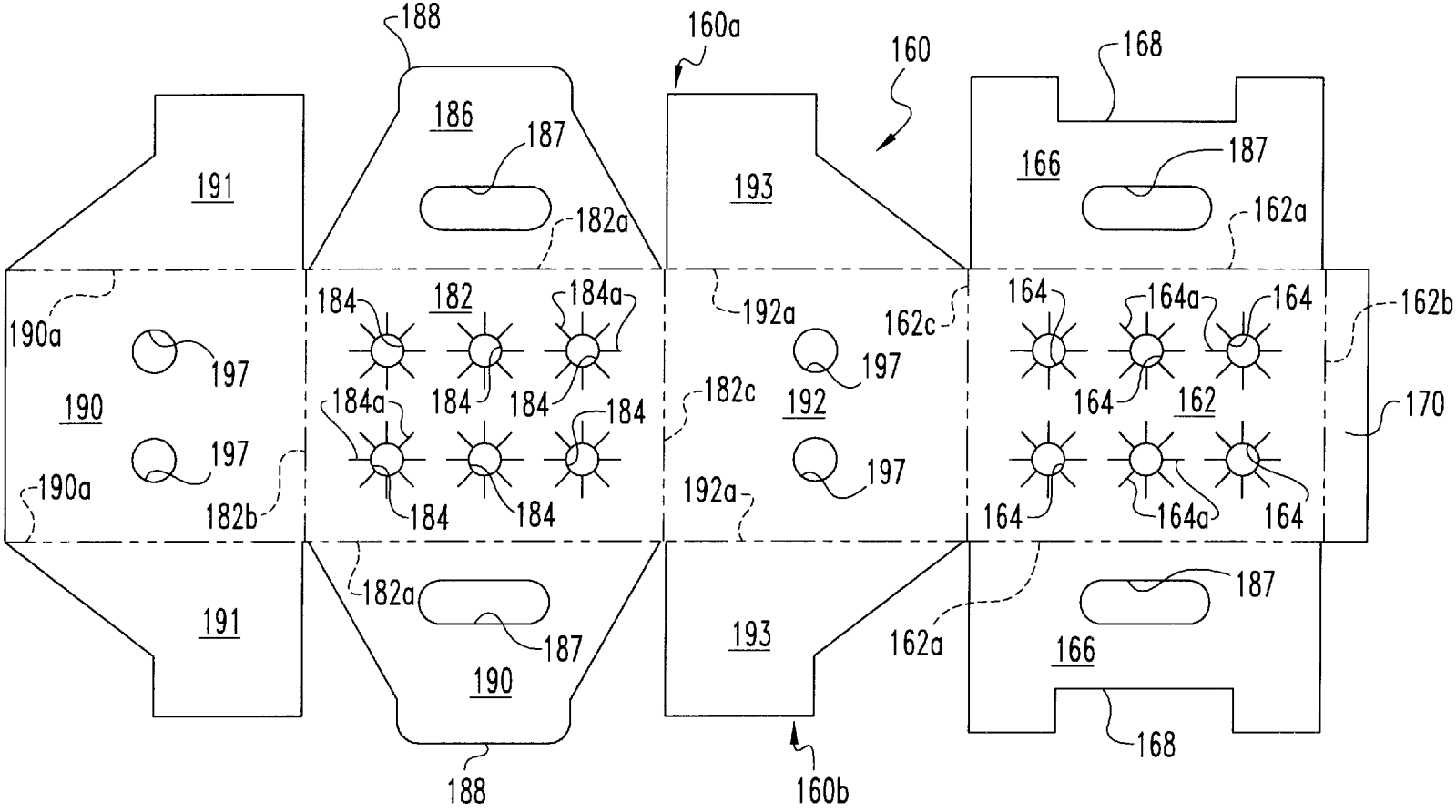
FIG. 9 is a plan view of the spacer of FIG. 8 in a generally planar, unassembled state.

Referring to FIG. 9, a generally planar form of spacer 160 prior to assembly is illustrated. In this form, spacer 160 depicts wall 162 hingedly connected to opposing handle flaps 166 along corresponding bend lines 162*a*. Each flap 166 defines a hand slot 187 therethrough and an interlocking tab recess 168. Wall 162 is also hingedly connected to glue flap 170 along bend line 162*b*.

Wall 182 is hingedly connected to sidewall 190 along bend line 182*b*. Sidewall 190 is hingedly connected to opposing side flaps 191 by corresponding bend lines 190*a*. Sidewall 190 also defines finger holes 197 therethrough. In addition, wall 182 is hingedly connected to sidewall 192 along bend line 182*c*. Sidewall 192 is hingedly connected to opposing side flaps 193 along corresponding bend lines 192*a*. Sidewall 192 defines finger holes 197 therethrough. Sidewall 192 is hingedly connected to wall 162 along bend line 162*c*.

Figure 11:
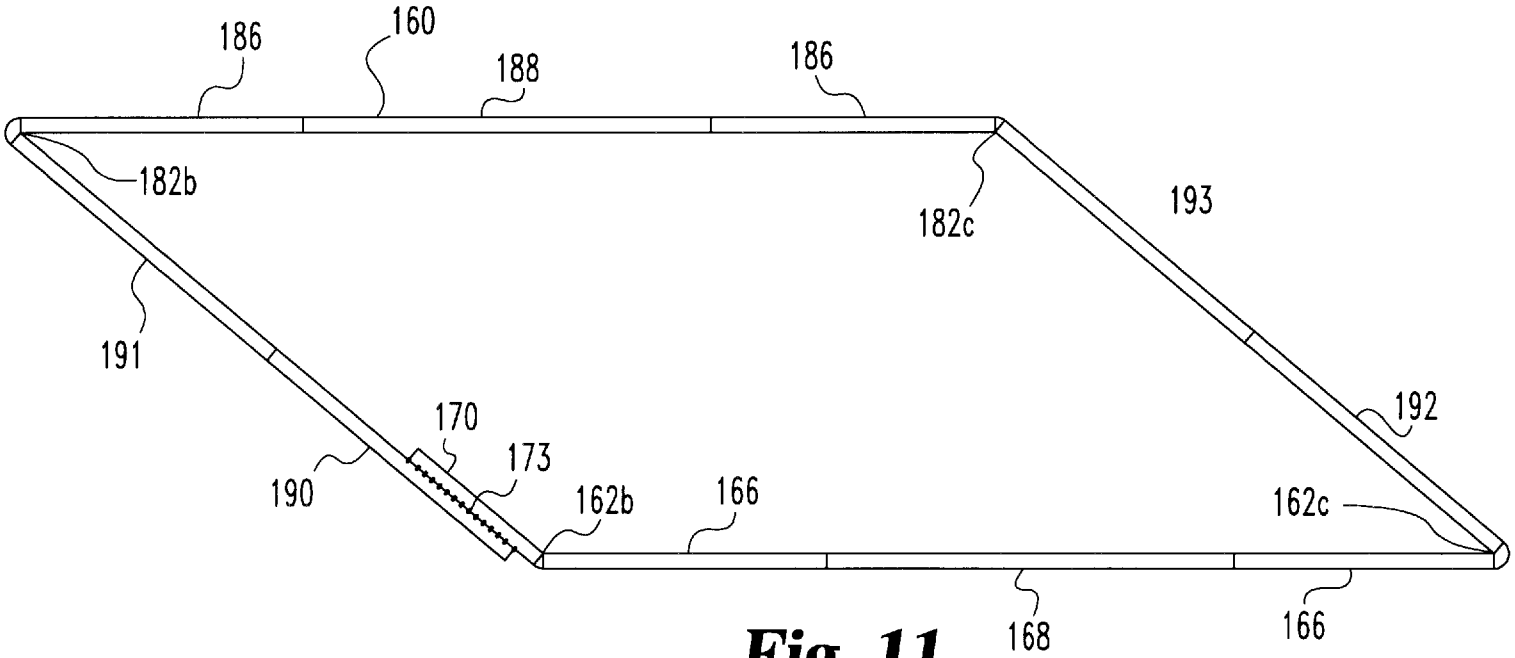
FIG. 11 is a view of the spacer of FIG. 8 in a partially collapsed state.

One mode of assembling spacer 160 from the form presented in FIG. 9 begins by bending walls 162, 182, 190, 192 to form corners at each bend line 162*c*, 182*c*, 182*b*. Next, flap 170 is bent about bend line 162*b* and bonded to an inner surface of sidewall 190 by adhesive 173. The end view of FIG. 11 corresponds to this stage of assembly of spacer 160. Flaps of sets 160*a*, 160*b* and walls 162, 182, 190, 192 are generally coplanar in this view. It should be appreciated that spacer 160 may be collapsed further from the partially collapsed configuration of FIG. 11 to become generally flat and occupy a minimal amount of space, which is ideal for transport and storage of spacer 160 prior to incorporation into lamp set 50.

Figure 10:
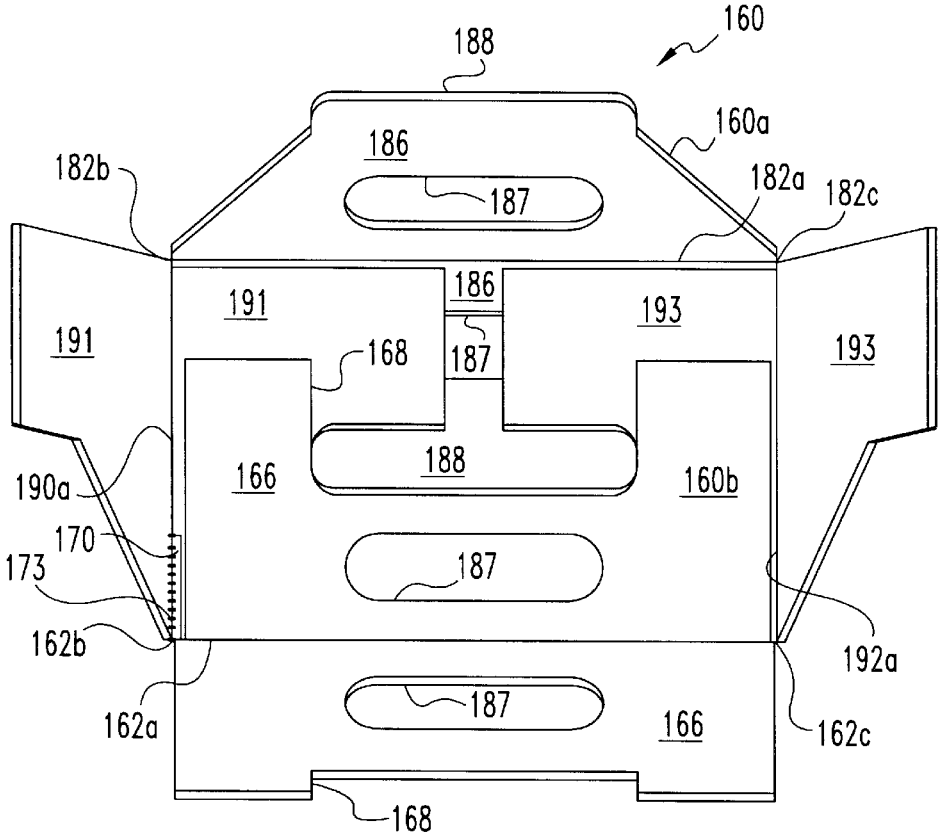
FIG. 10 is a view of the spacer of FIG. 8 in a partially assembled state.

Referring additionally to FIG. 10, a partially assembled state of spacer 160 is illustrated. In FIG. 10, flaps of set 160*b* are shown in an assembled, engaged configuration, and the remaining flaps of set 160*b* are shown in an unengaged configuration bent slightly outward relative to one another. To provide the fully assembled state shown in FIGS. 1, 2, and 8; the flaps of set 160*a* are engaged as follows: (1) handle flap 166 of set 160*a* is bent about line 162*a* toward corresponding handle flap 186, (2) side flaps 191, 193 of set 160*a* are bent about lines 190*a*, 192*a*, respectively, toward one another to overlap handle flap 166 of set 160*a*, (3) handle flap 186 of set 160*a* is then bent toward the other flaps of set 160*a*, and (4) tab 188 of flap 186 is inserted through a slot defined by the other flaps to interlock flap set 160*a*.

When assembled, spacer 160 provides a rigid construct of rectangular cross-section. Sidewalls 190, 192 define expansive opposing sides of spacer 160 suitable for bearing contact with corresponding sidewalls of box 30. When interlocked, sets 160*a*, 160*b* form generally planar opposing sides of spacer 160 suitable to engage corresponding sidewalls of box 30 in a bearing relationship.

Preferably, sheets of a corrugated cardboard or boxboard material are cut and scored to provide the planar form of box 30 presented in FIG. 2 and spacer 60, 160 presented in FIGS. 5 and 9, respectively. These materials are typically recyclable, biodegradable, and are easy to dispose of, providing significant improvements over foam endcap arrangements. The hinged connections of various flaps and walls of box 30 and spacers 60, 160 may be formed by folding at the corresponding bend lines to bias the material to bend therealong—operating as a hinge. Alternatively, scoring, slitting, and other techniques as would occur to one skilled in the art may be employed to hingedly connect the various flaps and walls of box 30 and spacers 60, 160 where indicated.

Although it is preferred that box 30 and spacers 60 and 160 be manufactured from a corrugated boxboard or cardboard material, other materials may be employed as would occur to one skilled in the art. Also, a different number of lamps 52 and different lamp shapes may be accommodated in alternative embodiments. Furthermore, different box and spacer shapes are envisioned as would occur to one skilled in the art.

The rectangular structures of spacers 60 and 160 when assembled provide a rigid, double-walled construct suitable for storage, packaging, unpacking, and transport of lamp set 50 under ordinary conditions. Moreover, finger holes 197 and handle slots 187 provide handles which may be used to carry lamp set 50 prior to or after removal from box 30. Preferably, handles are provided intergral to each side of spacer 160 as depicted by the drawings. Indeed, one common mode of opening box 30 is to remove only one sidewall to access lamp set 50. Typically, an uppermost, or top sidewall is removed to expose a top aspect of set 50. Referring to FIG. 1, if wall 38 of box 30 where removed during unpacking, the top aspect of set 50 would be exposed, appearing similar to the depiction of set 50 in FIG. 2 except that sidewalls 32, 34, 36, 40 and end walls 44, 46 of box 30 would surround set 50. For this mode, set 50 may be conveniently removed with one hand despite resistance of the surrounding walls by grasping hand slots 187 provided by assembled flap set 160*a* and pulling upward. Regardless of which side of spacer 160 is exposed at the top, slots 187 or holes 197 defined by the exposed side provide a handle to facilitate removal with a reduced risk of damage. Moreover, lamp set 50 may be reliably carried from one location to another by engaging slots 187 or holes 197 with one hand to suspend all of the weight of lamps 52 from the selected hand hold without threatening disassembly of lamp set 50.

Spacers 60, 160 cooperate with each other and box 30 to isolate each lamp in a protective manner. Referring back to FIG. 1, spacers 60 are each configured to provide separation distance D1 along axis L to space apart pins 58 of each of lamps 52 from a corresponding end wall 44, 46 of box 30. It should be appreciated that the back stop configuration of walls 62, 82 and the spacing from end walls 44, 46 provided by sidewalls 90, 92 define a protective cavity 96 in which pins 58 of lamps 52 reside. Preferably, distance D1 is at least about ½ inch. More preferably, distance D1 is at least about 1 inch.

Spacers 60, 160 also define separation distance D2 from sidewalls of box 30 along an axis perpendicular to axis L. Distance D2 protects enclosed lamps 52 of set 50 from punctures through the sidewalls of box 30. Preferably, distance D2 is at least about ½ of an inch. More preferably, distance D2 is at least about 1 inch.

It has been found that elongate lamps having a length of 50 inches or more and a diameter of less then 2 inches tend to flex relative to axis L during travel. When generally parallel lamps are arranged close to one another, this flexure may cause contact between two adjacent lamps. Such contact may result in damage. As a result, spacers 60, 160 have been designed to provide a minimum separation distance D3 to isolate each lamp from the others, where D3 is taken along an axis perpendicular to axis L. Preferably, D3 is at least about ⅛ of an inch. More preferably, D3 is at least ½ of an inch.

The following examples are representative of packaging test results achieved with the present invention and should not be considered limiting in character, but rather illustrative of selected preferred embodiments of the present invention.

EXAMPLE 1

Six lamps 52 are placed in two layers of three with spacers comparable to spacers 60, 160 to form a lamp set comparable to set 50. This set is enclosed in a box comparable to box 30. This package is formed from single-wall, scored and die-cut corrugated boxboard having a vertical C-flute corrugation. The package weight is approximately 11 pounds and the outer box edges are secured with a two inch pressure sensitive adhesive tape applied in multiple strips. The outer dimensions of the package are about 74×6.5×9.25 (L×W×D, outer dimensions of package in inches).

The package was vibrated for 51 minutes at 280 cycles per minute and dropped from a height of 30 inches ten times. The package was also tested by simulating an instantaneous impact in accordance with the Bridge Smite evaluation. Under this test, a 50 pound weight was dropped on the test sample from three inches. Inspection after performance of these tests revealed no visible damage to the packaging or lamps. The lamps remained intact and were functional after testing.

EXAMPLE 2

In this example, twelve lamps are accommodated by placing two lamp sets of the typed described in Example 1 next to each other and enclosing both in a box having sidewalls and flaps proportioned to accommodate the double set configuration. The spacers and the outer box are formed from a single-wall, scored and die-cut boxboard pad having a vertical C-flute corrugation. Package weight is about 18 pounds with dimensions of 74×9×13 (L×W×D, outer dimensions of package in inches). Two inch pressure sensitive adhesive tape was applied to the outer box in multiple strips to attain closure.

The double set configuration was exposed to vibration 51 minutes at 280 cycles per minute and dropped from a height of 30 inches ten times. Furthermore, a Bridge Smite Test was performed. Under this test, a 50 pound weight was dropped on the test sample from a height of three inches. Inspection after performance of these tests revealed no visible damage to the packaging or lamps. The lamps remained intact and were functional after testing.

All publications, patents, and patent applications cited in this specification are herein incorporated by reference as if each individual publication, patent, or patent application were specifically and individually indicated to be incorporated by reference and set forth in its entirety herein.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus, comprising:

a number of elongate tubular lamps oriented along a longitudinal axis, said lamps each having a first end opposite a second end along said axis, said number of lamps being at least three;

a first space configured to engage said first end of each of said lamps to maintain spacing therebetween;

a second spacer configured to engage said second end of each of said lamps to maintain spacing therebetween; and a third spacer positioned between said first and second spacers, said third spacer including a first wall defining a first number of openings and a second wall defining a second number of openings, said first and second openings being paired to define a number of passages each receiving a corresponding one of said lamps therethrough to space apart said lamps in cooperation with said first and second spacers and provide a packagable lamp set, said third spacer including a handle graspable from an exposed side of said third spacer to lift and carry said set;

wherein said lamps each include a first pair of conductive pins extending along said axis at said first end, said first spacer includes a first pair of spaced apart walls, said first spacer defines a first number of opening pairs each configured to receive said first end of a corresponding one of said lamps, said first opening pairs each have a first aperture defined through a first one of said first pair of spaced apart walls and sized to permit said corresponding one of said lamps to slide therethrough, and a second aperture defined through a second one of said first pair of spaced apart walls and sized to permit said first pair of pins of said corresponding one of said lamps to extend therethrough and engage said first end of said corresponding one of said lamps in a bearing relationship with said first spacer.

2. The apparatus of claim 1, wherein said first, second, and third spacers are made of corrugated boxboard.

3. The apparatus of claim 1, wherein said handle is integral to said third spacer and is configured to be grasped by one hand to suspend substantially all weight of the lamps therefrom.

4. The apparatus of claim 1, further comprising a box with a number of walls joined together to surround said set, and said first, second, and third spacers position each of said lamps at least about 1 inch away from any of said walls.

5. The apparatus of claim 1, wherein said third spacer has at least four sides and at least four handles including said handle, and said at least four sides each have a corresponding one of said at least four handles.

6. The apparatus of claim 1, wherein said number of lamps is at least six and each of said lamps has a length along said axis of at least about 50 inches.

7. The apparatus of claim 1, wherein said handle includes at least one hole through said exposed side of said third spacer.

8. The apparatus of claim 1, wherein said third spacer is yieldingly slidable along said lamps relative to said first and second spacers.

9. The apparatus of claim 1, wherein said lamps each include a second pair of conductive pins extending along said axis at said second end, said second spacer includes a second pair of spaced apart walls, said second spacer defines a second number of opening pairs each configured to receive said second end of said corresponding one of said lamps, said second opening pairs each have a first aperture defined through a first one of said second pair of spaced apart walls and sized to permit said corresponding one of said lamps to slide therethrough, and a second aperture defined through a second one of said second pair of spaced apart walls and sized to permit said second pair of pins of said corresponding one of said lamps to extend therethrough and correspondingly engage said second end of said corresponding one of said lamps in a bearing relationship with said second spacer.

10. The apparatus of claim 9 further comprising a box, said set being removably placed in said box, said first and second spacer being configured to position said first pair of pins and said second pair of pins at least about 1 inch away from any walls of said box.

11. An apparatus, comprising:

at least two elongate tubular lamps oriented along a longitudinal axis, said lamps each having a first end opposite a second end along said axis;

a first spacer configured to engage said first end of each of said lamps to maintain spacing therebetween;

a second spacer configured to engage said second end of each of said lamps to maintain spacing therebetween;

a third spacer positioned between said first and second spacers, said third spacer including a first wall defining a number of passages each receiving a corresponding one of said lamps therethrough to space apart said lamps in cooperation with said first and second spacers to provide a packagable lamp set; and a box having a pair of end walls and a number of elongated sidewalls configured to enclose said set, said box being openable to expose a top aspect of said set, said third spacer having a handle adjacent one of said sidewalls and graspable from said top aspect when exposed by opening said box at said one of said sidewalls to remove said set from said box as a unit by pulling thereon, said handle being configured to carry said set.

12. The apparatus of claim 11, wherein said box and said first, second, and third spacers are made of corrugated boxboard.

13. The apparatus of claim 11, wherein said handle is configured to be grasped by one hand.

14. The apparatus of claim 11, wherein said first, second, and third spacers position each of said lamps at least about 1 inch away from any of said end walls and said sidewalls when said box encloses said set.

15. The apparatus of claim 14, wherein said box presents a generally rectangular parallelepiped shape when enclosing said set.

16. The apparatus of claim 11, wherein said third spacer has at least four sides and at least four handles including said handle, and said at least four sides each have a corresponding one of said at least four handles.

17. The apparatus of claim 11, wherein at least six lamps are included in said set, said lamps each have a length along said axis of at least about 50 inches, and said lamps are separated from each other by a distance of at least about 0.5 inch in said set.

18. The apparatus of claim 11, wherein said handle is integral with said third spacer, and is configured to suspend substantially all weight of the lamps therefrom.

19. The apparatus of claim 11, wherein said handle includes at least one hole through said third spacer exposed with said top aspect of said set.

20. The apparatus of claim 11, wherein said handle includes a plurality of finger holes through said third spacer exposed with said top aspect of said set.

21. The apparatus, comprising:

at least two elongate tubular lamps oriented along a longitudinal axis, said lamps each having a first end opposite a second end along said axis;

a first spacer configured to engage said first end of each of said lamps to maintain spacing therebetween;

a second spacer configured to engage said second end of each of said lamps to maintain spacing therebetween;

a third spacer positioned between said first and second spacers, said third spacer defining a number of passages each receiving a corresponding one of said lamps therethrough to space apart said lamps in cooperation with said first and second spacers to provide a packagable lamp set; and a box configured to encloses said set, said box being openable to expose a top aspect of said set, said third spacer having a handle graspable from said top aspect to lift and carry said set, said handle being configured to facilitate removal of said set from said box by pulling thereon;

wherein said lamps each include a pair of conductive pins extending along said axis at said first end, said first spacer includes a first wall spaced apart from a second wall along said axis, said first spacer defines a number of opening pairs each correspondingly receiving said first end of each said lamps, said pairs each have a first opening defined through said first wall and sized to permit any of said lamps to slide therethrough and a second opening defined through said second wall and sized to permit said pair of pins of any of said lamps to extend therethrough and correspondingly engage said first end of any of said lamps in a bearing relationship.

22. The apparatus of claim 21, wherein said handle includes at least one hole through said third spacer exposed with said top aspect of said set.

23. The apparatus of claim 21, wherein said handle includes a slot graspable by inserting a hand therein.

24. The apparatus of claim 21, wherein said first and second spacers are generally identical to each other.

25. A packaging system, comprising: a box and a packagable lamp set configured for enclosure in said box, said set including:

at least four elongate tubular lamps each having opposite ends along a longitudinal axis with a pair of pins extending from each of said ends;

a first spacer and a second spacer each being yieldingly retained on a corresponding one of said ends and each including a first wall spaced apart from a second wall and at least four opening pairs each having a first opening defined through said first wall sized to permit any of said lamps to slide therethrough and a second opening defined through said second wall sized to permit said pair of pins of said corresponding one of said ends to extend therethrough and engage said corresponding one of said ends in a bearing relationship with said second wall; and a third spacer positioned between said first and second spacers, said third spacer having two spaced apart walls defining at least four passages each yieldingly retaining a corresponding one of said lamps therethrough;

wherein said first, second, and third spacers cooperate to yieldingly retain said lamps in a spaced apart relationship of at least two layers with at least two lamps in each layer, said said first, second, and third spacers being in a yieldingly fixed position relative to said lamps to maintain said spaced apart relationship when being carried by hand outside of said box.

26. The system of claim 25, wherein said first, second, and third spacers each have a common number of sidewalls configured for bearing contact with a corresponding number of walls of said box when said set is enclosed in said box.

27. The system of claim 25, wherein said two spaced apart walls of said third spacer are joined together by four sidewalls to bear against said box when said set is enclosed in said box, said four sidewalls being generally perpendicular to said two spaced apart walls.

28. The system of claim 25, wherein said first and second walls of each of said first and second spacers are joined together by four generally planar sidewalls configured to bear against said box when said set is enclosed in said box, said four sidewalls being generally perpendicular to said first and second walls.

29. The system of claim 25, wherein said third spacer has a handle including at least one hole therethrough to lift and carry said set.

30. The system of claim 25, wherein said first, second, and third spacers position said lamps at least about an inch away from said box when enclosed therein.

31. The system of claim 30, wherein said lamps each are at least about 50 inches in length along said longitudinal axis.

32. The system of claim 31, wherein said box, said first spacer, said second spacer, and said third spacer are formed from corrugated boxboard.

* * * * *